United States Patent [19]

Fujiwhara et al.

[11] 4,113,490

[45] Sep. 12, 1978

[54] METHOD FOR PROCESSING LIGHT-SENSITIVE SILVER HALIDE PHOTOGRAPHIC MATERIALS

[75] Inventors: Mitsuto Fujiwhara; Syunji Matsuo; Toyoaki Masukawa; Mikio Kawasaki; Yutaka Kaneko, all of Hino, Japan

[73] Assignee: Konishiroku Photo Industry Co., Ltd., Nihonbashi-Muro, Japan

[21] Appl. No.: 814,121

[22] Filed: Jul. 8, 1977

Related U.S. Application Data

[63] Continuation of Ser. No. 594,492, Jul. 9, 1975, abandoned.

[30] Foreign Application Priority Data

Jul. 12, 1974 [JP] Japan ..... 49-80321
Sep. 21, 1974 [JP] Japan ..... 49-109213

[51] Int. Cl.[2] ..... G03C 5/32; G03C 5/38; G03C 5/50; G03C 7/16

[52] U.S. Cl. ..... 96/60 R; 96/61 R; 96/59; 96/22

[58] Field of Search ..... 96/66, 22, 61, 62, 95, 96/60, 59

[56] References Cited

U.S. PATENT DOCUMENTS

| | | | |
|---|---|---|---|
| 3,674,490 | 7/1972 | Matejec | 96/48 R |
| 3,765,890 | 10/1973 | Weyde | 96/48 R |
| 3,765,891 | 10/1973 | Travis | 96/50 R |
| 3,820,997 | 6/1974 | Shirasu | 96/56 |
| 3,822,129 | 7/1974 | Dunn et al. | 96/60 R |
| 3,834,907 | 9/1974 | Bissonette | 96/74 |
| 3,841,873 | 10/1974 | Mowrey | 96/22 |

*Primary Examiner*—Mary F. Kelley
*Attorney, Agent, or Firm*—Haseltine, Lake, & Waters

[57] ABSTRACT

An exposed light-sensitive silver halide photographic material containing a coupler is processed with a developing bath and thereafter with an amplifying bath containing hydrogen peroxide, said process being characterized in that a compound acting on the silver halide at the unexposed portion of the photographic material is incorporated into the developing bath or into a bath used for a treatment effected after the development and before processing with the amplifying bath.

9 Claims, No Drawings

METHOD FOR PROCESSING LIGHT-SENSITIVE SILVER HALIDE PHOTOGRAPHIC MATERIALS

This is a continuation of application Ser. No. 594,492 filed July 9, 1975 abandoned.

This invention relates to a novel method for processing light-sensitive silver halide photographic materials. More particularly, the invention is concerned with a novel method for processing light-sensitive silver halide photographic materials, characterized in that photographic coupler-containing light-sensitive silver halide photographic materials are processed with a solution containing hydrogen peroxide to obtain amplified color images.

Light-sensitive silver halide photographic materials are high in photosensitivity and excellent in image-forming ability, and hence have frequently been used in general. Recently, however, world-wide shortage of silver resources and rise in cost of raw materials derived therefrom have come into question. This question is regarded to be serious as an industrially disadvantageous factor particularly for light-sensitive silver halide photographic materials which require large quantities of silver, and a demand for the development of techniques capable of solving said question has become clamourous. In order to meet the above-mentioned demand, silver-saving type light-sensitive silver halide photographic materials have been proposed, and several techniques concerning such photographic materials have already been known. For example, Japanese Patent Publication No. 13576/74 discloses a method using a so-called 2-equivalent type coupler prepared by introducing a substituent into the active position of a color coupler so as to attain such advantage that the amount of silver required to form one molecule of a dye, which amount has heretofore been four atoms, can be reduced to two atoms. According to said method, the theoretical amount of silver to be used may be reduced to one-half the amount required in the case where the conventional 4-equivalent type coupler is used, and, in practice, it is possible to reduce the amount of silver to less than one-half the amount required in the case of the 4-equivalent type coupler, since the 2-equivalent type coupler is higher in silver utilization efficiency than the 4-equivalent type coupler. Even when such method is adopted, however, the upper limit of the amount of silver capable of being reduced is about one-third the amount required at present, and no more reduction in amount of silver can be expected.

Paying attention to the developed silver obtained by subjecting a light-sensitive silver halide photographic material to imagewise exposure followed by development, there has been proposed a so-called image amplification method in which the oxidation product of a developing agent is formed more effectively by use of said silver as a catalyst, thereby forming a high density color image. According to this method, the developed silver can be repeatedly used many times, so that color images can be obtained quite efficiently and the amount of silver can be reduced to a great extent.

As typical techniques for the image amplification of light-sensitive silver halide photographic materials, there have heretofore been known, for example, the method disclosed in British Patent 1,268,126 in which the images are amplified by use of peroxy compounds, and the method disclosed in Japanese Patent Publication No. 9728/73 in which color images are amplified taking advantage of the catalytic actions of cobalt complexes. Further, as to a similar technique for the amplification of color images, J. S. Friedman suggests on page 406 of "History of Color Photography (1956)," published by the American Photographic Publishing Co., the possibility of color image amplification by use of hydrogen peroxide and p-phenylenediamine. All these methods can be effectively increase the densities of images and hence are quite effective techniques when viewed from the standpoint of the saving of silver resources. However, it is the actual state that the said methods have not been put into practice yet. The major reason therefor lies in that the processing baths used in said methods are extremely low in storability.

Hydrogen peroxide and cobalt (III) ion complex salts have been known as typical oxidizing agents for amplifying color images, for example, and it appears that hydrogen peroxide is superior in efficiency. Despite the fact that hydrogen peroxide has been well known as an oxidizing agent hitherto, a method using hydrogen peroxide has not come to be put into practice. This is ascribable to two great disadvantages of the said method, namely that marked fog tends to be formed in photographic materials and that the amplification ratio is unstable (the term "amplification ratio", referred to herein means the ratio between the maximum density, assumed as 1, obtained in the case where a photographic material is exposed and then subjected to usual processing, and the maximum density obtained in the case where the same photographic material as above is exposed in the same manner as above and then subjected to amplification processing). In order to overcome these disadvantages, there have been proposed methods using chelating agents or stabilizers in combination with hydrogen peroxide. According to these methods, the processing baths can somewhat withstand the processing when the running period is within one week, but if the running period is longer, the disadvantages are that not only the formation of fog and the degradation in maximum density ($D_{max}$) become marked, but also the processing time required for the attainment of a definite amplification ratio is greatly extended.

On the other hand, when hexamminecobalt trichloride or the like cobalt (III) ion complex salt is used, the processing bath is lowered in amplification ability within such a short period as 3 hours in extreme cases, and if the bath is allowed to stand for about 2 weeks, severe fog is formed in the photographic material processed therewith even when the processing solution has completely been sealed with nitrogen gas. In order to overcome this disadvantage, many improvements have been attempted. When evaluated from the standpoint of practicality, however, the said improvements are no more than minor improvements.

With an aim to develop an image amplification method capable of sufficiently withstanding a long period running in a large scale color laboratory, we conducted extensive studies to accomplish the method of the present invention.

It is therefore a primary object of the present invention to provide a novel method for processing light-sensitive silver halide photographic materials which is free from such disadvantages as mentioned previously, characterized in that hydrogen peroxide, which is high in oxidizing efficiency among various oxidizing agents, is used as an oxidizing agent for oxidation of a color developing agent in the presence of imagewise-developed silver of photographic materials as a medium, thereby forming color images increased in amplification ratio.

A still further object of the invention is to provide a color image amplification method in which excellent color images can be obtained from light-sensitive silver halide photographic materials reduced in amount of silver.

Other objects of the invention will become apparent from the following description.

The above objects can be accomplished by adoption of a method for processing light-sensitive silver halide photographic materials, wherein a coupler-containing silver halide photographic material after imagewise exposure is processed with a developing bath and then with an amplifying bath containing hydrogen peroxide, characterized in that a compound acting on the silver halide at the unexposed portion of the said photographic material is incorporated into the developing bath or into a bath used for the treatment effected after the development and before the amplification.

According to one embodiment of the present invention, the above-mentioned compound is a compound capable of deactivating the silver halide at the unexposed portion (hereinafter the said compound will be referred to as "deactivator").

According to another embodiment of the present invention, the above-mentioned compound is a compound capable of dissolving the silver halide at the unexposed portion (hereinafter the said compound will be referred to as "silver halide solvent").

As deactivators preferable for use in the present invention, there may be shown, for example, mercapto compounds, azole compounds, oxoniums, halogen ions and dyes. Concrete examples of the deactivators used in the present invention are shown below, but deactivators usable in the invention are not limited to these.

(Mercapto compounds)

(1) 2-Mercaptobenzimidazole
(2) 2-Mercaptobenzothiazole
(3) 2-Mercapto-5-nitrobenzothiazole
(4) 4-Methyl-2-mercaptothiazole
(5) 4,5-Dimethyl-2-mercaptothiazole
(6) 1-Phenyl-5-mercaptotetrazole
(7) 1,2-Dimethyl-5-mercapto-1,3,4-triazole
(8) 2-Mercapto-5-phenyl-1,3,4-oxadiazole
(9) β-Mercaptoacetic acid
(10) β-Mercaptopropionic acid
(11) Thiosalicylic acid (Azole compounds)

(12) Benzotriazole
(13) 5-Nitrobenzimidazole
(14) 5-Methylbenzotriazole
(15) 4-Chlorobenzotriazole
(16) 5,5-Diphenylhydantoin
(17) 2-Methyl-3-(γ-sulfoxypropyl)-benzoselenazole
(18) 3-Methylbenzothiazole toluenesulfonate (Oxonium compounds)

(19) N-Isopropyl-α-picolinium bromide
(20) N-Ethyl-2-methylbenzothiazolium chloride (Dyes)

(21) Phenosafranine
(22) Pinakryptol yellow
(23) 1,1',3,3,3',3'-Hexamethyl-5,5'-dinitroimidocarboxyanine-p-toluenesulfonate
(24) 1,3-Diaryl-2-[(3,5-dimethyl-1-phenyl-4-pyrazolyl)vinyl]-imidazo-(4,5-b)-quinoxalium iodide (Others)

(25) Benzyladenine
(26) 8-Hydroxyquinoline
(27) o-Phenanthroline
(28) Thiosugar

All the above-mentioned compounds are those which are adsorbed on silver halides or react with silver to form sparingly soluble silver salts, and can advantageously be used in the present invention.

In the present invention, a photographic coupler-containing light-sensitive silver halide photographic material is developed and, prior to processing with an amplifying bath containing hydrogen peroxide, is processed with a bath containing the aforesaid deactivator. This bath may contain only the deactivator or may additionally contain other processing chemical.

According to a preferred embodiment of the present invention, the deactivator is incorporated into a color developer. According to another preferred embodiment of the invention, the deactivator is used in combination with a black-white developing agent or a color developing agent to form a processing solution.

The amount of the deactivator used in the present invention varies depending on the kind thereof and the kinds of the processing bath and photographic material used, but is in the range from 0.1 mg to 10 g/l, and is ordinarily in the range from 1 to 500 mg/l, preferably from 3 to 100 mg/l.

Further, typical examples of the treatment steps, to which the processing method of the present invention is applicable, are as shown below, but the invention is not limited to these, wherein □ represents a deactivator-containing bath, and the letter in ( ) shows the presence of black-white developing agent B or color developing agent C.

1. [Development (C)] - amplification - desilver-fixing - water-washing - stabilization.
2. [Development (B)] - water-washing - pre-bath (C) - amplification - fixing - water-washing.
3. Development (B) - [pre-bath (C)] - amplification - fixing - water-washing.
4. [Development (B and C)] - amplification - water-washing.
5. Development (B) - bleaching - secondary exposure - [secondary development (B and C)] - amplification - water-washing, stabilization - rinsing.
6. Development (C) - [pre-bath (C)] amplification - desilvering - water-washing - fixing - water-washing - stabilization - rinsing.
7. [Development (B)] - secondary exposure - [development (C)] - amplification - desilver-fixing - water-washing - stabilization.
8. [Development (B and C)] - amplification - bleach-fixing - water-washing - stabilization.
9. [Development (B and C)] - amplification - fixing - water-washing - stabilization.
10. [Development (B and C)] - amplification - bleaching - fixing - water-washing - stabilization.

As silver halide solvents preferable for use in the present invention, there may be shown thiosulfates, thiocyanates and cyanides. Concrete examples of the silver halide solvents used in the present invention are sodium thiosulfate, potassium thiosulfate, ammonium thiosulfate, potassium cyanide, sodium cyanide, sodium thiocyanide, ammonium thiocyanate and thiosinamine, though these are not limitative.

The amount of the silver halide solvent used in preparing the processing solution according to the present invention varies depending on the kind thereof and the kinds of the processing bath and photographic material used, but is preferably in the range from 1 to 20 g/l when it is used in combination with the developing agent, and in the range from 1 to 200 g/l when it is used alone. In this case, the pH of the processing solution is preferably from 6 to 12. The processing solution may be incorporated with, in addition to the developing agent, various additives used in ordinary black-white developers, color developers and fixing solutions, e.g. preservatives, development promoters, inhibitors, alkali agents, pH regulators, buffer agents and hardeners.

Typical examples of the treatment steps, to which the processing method of the present invention is applicable, are as shown below, but the invention is not limited to these.

1. Development (B) - [ ] - pre-bath (C) - amplification - desilver-fixing - water-washing - stabilization - rinsing.
2. [Development (C)] - amplification - water-washing - stabilization - rinsing.
3. Development (B) - bleaching - secondary exposure - secondary development (C) - [ ] - pre-bath (C) - amplification - water-washing.
4. [Development (B)] - water-washing - pre-bath (C) - amplification - water-washing - stabilization.
5. Development (B) - water-washing - [pre-bath (C)] - amplification - water-washing.

In the said treatment, typical examples of color developing agents as main ingredients preferable for use in the present invention are p-phenylenediamine type compounds such as diethyl-p-phenylenediamine hydrochloride, monomethyl-p-phenylenediamine hydrochloride, dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-methanesulfonamidoethyl-4-aminoaniline, 4-N-ethyl-N-β-hydroxyethylaminoaniline, 4-amino-3-methyl-N,N-diethylaniline hydrochloride, 4-amino-3-methyl-N-ethyl-N-β-hydroxyethylaniline sulfate, 4-amino-3-β-(methanesulfonamido)ethyl-N,N-diethylaniline and 4-amino-N-(2-methoxyethyl)-n-toluidine. These color developing agents may be used either singly or in admixture of two or more members, or in combination with a black-white developing agent.

Typical examples of the black-white developing agent are hydroquinone, monomethyl-p-aminophenol sulfate and 1-phenyl-3-pyrazolidone.

Further, the color developing bath may contain an alkali agent such as, for example, sodium hydroxide, ammonium hydroxide, sodium carbonate, sodium sulfate or sodium sulfite, and may contain various additives, e.g. an alkali metal halide such as potassium bromide and a development regulator such as citrazinic acid.

The photographic material, which has been subjected to color development in the above-mentioned manner, is then processed, either as it is or after simple water-washing (rinsing) or after treatment with a pre-bath containing a color developing agent, with a hydrogen peroxide-containing bath according to the present invention. If necessary, the photographic material is further subjected to pre-hardening treatment and to pre-bath treatment for better impregnation with the color developing agent, and, in the case of reversal development, it is subjected to black-white development, bleaching, etc. In case the silver halide or developed silver is desired to be removed out of the system, there is adopted a treatment using a fixing solution, either alone or in combination with a bleaching solution, or using a bleach-fixing solution, in general. This treatment is carried out in combination with other various treatments such as, for example, water-washing, stopping and stabilization treatment. As the fixing component, there is used a silver halide solvent such as sodium thiosulfate or ammonium thiosulfate, while as the bleaching component, there is used potassium ferricyanide, ferric ammonium ethylenediaminetetraacetate or sodium salt.

The method of the present invention is usable for the processing of a coupler-containing light-sensitive silver halide photographic material, and is advantageously applied particularly to a so-called silver-reduced light-sensitive silver halide photographic material containing a silver halide and a photographic coupler in an amount stoichiometrically larger than the available silver of said silver halide. According to the present invention, the amount of silver used can be reduced to less than one-fourth the amount of silver required in the prior art. Examples of the silver halide used in this case are silver chloride, silver halide, silver iodide, and mixed silver halides such as silver chlorobromide, silver iodobromide and silver iodochlorobromide. Emulsions of these silver halides may be prepared by any known process. For example, the silver halide emulsion used in the present invention may be any of so-called conversion emulsion, Lippmann emulsion or covered grain emulsion which may have previously been fogged either optically or chemically, and is suitably selected according to the kind and usage of the resulting photographic material. Further, the kind, halogen content and proportion, average particle size and size distribution of the silver halide emulsion are also selected suitably according to the kind and usage of the resulting photographic material. For example, an emulsion composed mainly of silver chloride which is fine in particle size and narrow in size distribution is used for preparation of a photographic material required to be relatively low in speed and high in image quality, while an emulsion relatively large in particle size and less in silver chloride content is used for preparation of a photographic material required to be relatively high in speed. Further, an emulsion which has previously been fogged is used for preparation of a direct positive type photographic material. These silver halide emulsions may be chemically sensitized by use of active gelatin; sulfur sensitizers, e.g. allylthiocarbamide, thiourea and cystin; selenium sensitizers; or noble metal sensitizers, e.g. gold sensitizers such as potassium aurithiocyanate, potassium chloroaurate and 2-aurosulfobenzothiazole methochloride, or sensitizers composed of water-soluble salts of ruthenium, rhodium and iridium, such as ammonium chloropalladate, potassium chloroplatinate and sodium chloropalladite (some of these act as sensitizers or antifoggants depending on their amounts), either alone or in proper combination (e.g. combination of gold sensitizer with sulfur sensitizer, or combination of gold sensitizer with selenium sensitizer). Further, these silver halide emulsions may be optically sensitized to desired wavelength regions by use of optical sensitizers, e.g. cyanine or merocyanine dyes such as zeromethine, monomethine, dimethine or trimethine dyes.

The silver halide is dispersed in a suitable protective colloid to constitute a photosensitive layer. As protective colloids for constituting the photosensitive layer and other layers such as, for example, inter layer, protective layer and filter layer, gelatin is used in general. In addition, there are used gelatin derivatives, colloidal albumins, cellulose derivatives or synthetic resins such as polyvinyl compounds, e.g. polyvinyl alcohols. These are used either alone or in combination with each other. Further, acetylcellulose having an acetyl content of about 19 to 26% or water-soluble ethanolamine cellulose acetate may be used in combination therewith.

The light-sensitive silver halide photographic materials used in the present invention contain couplers for forming color images. Examples of useful couplers are open-chain methylene type yellow couplers, 5-pyrazolone type magenta couplers, and phenol or naphthol type cyan couplers. These couplers may be any of so-called 2-equivalent type or 4-equivalent type couplers, and may be used in combination with azo type colored couplers, osazone type compounds or development diffusible dye-yielding type couplers for automasking. In this case, it is desirable to use the above-mentioned masking couplers in combination with so-called colorless couplers which are colorless before color development. For further enhancement in photographic properties, the photographic materials may be incorporated with so-called competing couplers, DIR (Development Inhibitor Releasing) couplers and BAR (Bleach Accelerator Releasing) couplers in combination with other couplers.

As yellow couplers, there have heretofore been used open-chain ketomethylene compounds. For example, effective as pivalyl acetanilide type yellow couplers are the compounds disclosed in French Pat. No. 1,291,110, and effective as benzoyl acetanilide type yellow couplers are the compounds disclosed in Japanese Patent Publication No. 19031/71 and U.S. Pat. No. 2,875,051. Further, the active position-O-allyl-substituted couplers as disclosed in U.S. Pat. No. 3,408,194, the active position-O-acyl-substituted couplers as disclosed in U.S. Pat. No. 3,447,928, the active position-hydantoin compound-substituted couplers is disclosed in Japanese Patent Laying Open-to-Public No. 29432/73, the active position-urazol compound-substituted couplers as disclosed in Japanese Patent Laying Open-to-Public No. 66834/73, the active position-succinic acid imide compound-substituted couplers as disclosed in Japanese Patent Publication No. 13576/74, the active position-monooximide compound-substituted couplers as disclosed in Deutsches Offenlegungsschrift No. 2,433,812, the active position-pyridazone compound-substituted couplers as disclosed in Japanese Patent Laying Open-to-Public No. 10736/74, the active position-fluorine-substituted couplers as disclosed in British Pat. No. 94,490, the active position-chlorine- or bromine-substituted couplers as disclosed in British Pat. No. 780,507, and the active position-O-sulfonyl-substituted couplers as disclosed in British Pat. No. 1,092,506, which are so-called 2-equivalent type couplers, can be effective yellow couplers. Particularly effective among these yellow couplers are those disclosed in U.S. Pat. No. 3,408,194, Japanese Patent Laying Open-to-Public No. 29432/73, Deutsches Offenlegungsschrift No. 2,433,812 and Japanese Patent Laying Open-to-Public No. 66834/73.

The magenta couplers used in the present invention include pyrazolone type, pyrazolotriazole type, pyrazolinobenzimidazole type and indazolone type compounds. Preferable as the pyrazolone type magenta couplers are those disclosed in U.S. Pat. Nos. 3,127,269, 2,600,788, 3,519,429, 3,419,391 and 3,062,653, British Pat. No. 1,342,553, West German Pat. No. 2,162,778, Japanese Patent Laying Open-to-Public No. 29639/74 and U.S. Pat. No. 3,684,514; preferable as the pyrazolotriazole type magenta couplers are those disclosed in West German Pat. No. 1,810,464 and Belgian Pat. No. 792,525; preferable as the pyrazolinobenzimidazole type magenta couplers are those disclosed in U.S. Pat. No. 3,061,432, Japanese Patent Publication No. 60479/71 and West German Pat. No. 2,156,111; and preferable as the indazolone type magenta couplers are those disclosed in Belgian Pat. No. 769,116. Among these, particularly preferable for use in the present invention are the magenta couplers disclosed in U.S. Pat. No. 3,684,514 and the 3-anilinopyrazolone magenta couplers disclosed in U.S. Pat. No. 3,127,269.

Useful cyan couplers usable in the present invention are the phenol compounds disclosed in, for example U.S. Pat. Nos. 2,423,730, 2,801,171 and 2,895,826, and Belgian Pat. No. 779,512; the active position-O-aryl-substituted naphthol compounds disclosed in U.S. Pat. No. 2,474,293 and British Pat. No. 1,084,480; and the phenol and naphthol compounds disclosed in Japanese Patent Laying Open-to-Public No. 37425/72, Deutsches Offenlegungsschrift Nos. 2,424,946 and 2,520,820, and German Patent Application No. P25 04 844.6.

As colored magenta couplers, there are used colorless magenta couplers having active positions substituted by arylazo or hetearylazo compounds which are disclosed in, for example, U.S. Pat. Nos. 3,005,712, 2,983,608, 2,801,171 and 3,684,514, and British Pat. No. 937,621.

As colored cyan couplers, there may be used the active position-arylazo-substituted couplers disclosed in U.S. Pat. Nos. 3,034,892, 2,521,908 and 3,811,892 and British Pat. No. 1,255,111, and masking couplers of such type that the dyes flow into the processing baths by reaction with the oxidation products of developing agents which are disclosed in Deutsches Offenlegungsschrift No. 2,424,946, German Patent Application No. P25 04 844.6 and British Pat. No. 1,084,480.

As competing couplers, there are used, for example, citrazinic acid and the like compounds disclosed in U.S. Pat. No. 2,742,832; and as white couplers, there are used those disclosed in West German Pat. No. 1,155,676.

A silver halide emulsion containing a photograhic coupler, which has been prepared in the above manner, is applied to the form of a layer onto a support, if necessary together with sub layer, inter layer, filter layer, anticurling layer, protective layer, etc., whereby the light-sensitive silver halide photographic material used in the present invention is obtained. Examples of the support usable in this case are paper, laminated papers (e.g. a laminate of polyethylene and paper), glass plates, and films or sheets of such substrates as cellulose acetate, cellulose nitrate, polyesters, polycarbonates, polyamides, polystyrenes and polyolefins. In order to enhance the adhesion thereof to the individual layers, the said supports may be subjected to various surface treatments such as, for example, saponification, corona discharge, subbing, setting, etc.

Fundamentally, a photographic material is composed at least of a support and a photosensitive layer provided thereon. As mentioned previously, however, it has proper layers at various positions, and is composed of more than several layers, in general. Further, the photosensitive layer itself may be composed of a laminate of, for example, a layer containing a relatively high speed silver halide and a layer containing a relatively low speed silver halide which have been color-sensitized to same or different wavelength regions.

The photographic material used in the present invention may contain various photographic additives in the photosensitive layer and/or other layers, e.g. inter layer, sub layer, filter layer, protective layer and image-receiving layer. Examples of such photographic additives are stabilizers, e.g. mercury compounds, triazoles, azaindenes, and quaternary benzothiazolium, zinc or cadmium salts; sensitizers such as quaternary ammonium salts or polyethylene glycols; film-property improvers, e.g. glycerin, dihydroxyalkanes such as 1,5-pentadiol, esters of ethylenebisglycolic acid, bisethoxydiethylene glycol succinates, amides of acrylic type acids, and polymer dispersions; hardeners, e.g. formaldehyde, halogen-substituted fatty acids such as mucochloric and mucobromic acids, compounds having acid anhydride groups, dicarboxylic acid chlorides, disulfonic acid chlorides, biesters of methanesulfonic acid, sodium bisulfite derivatives of dialdehydes whose aldehyde groups have been separated by 2 to 3 carbon atoms, bisaziridine, and ethyleneimines; vehicles, e.g. saponin, lauryl or oleyl monoethers of polyethylene glycols, and sulfated and alkylated polyethylene glycol salts; coating aids, e.g. sulfosuccinic acid salts; organic solvents, e.g. coupler solvents (high and/or low boiling organic solvents such as dibutyl phthalate, tricresyl phosphate, acetone, methanol, ethanol and ethylene cellosolve); so-called DIR compounds which, at the time of color development, yield color development inhibitors and, at the same time, form substantially colorless compounds; and such additives as antistatic agents, defoaming agents, ultraviolet absorbers, fluorescent brightening agents, anti-slip agents, matting agents, and anti-halation or anti-irradiation agents. These additives may be used either singly or in combination of two or more members.

The light-sensitive silver halide photographic materials used in the present invention can successfully be put into various uses, and are used as, for example, general negative photographic materials, general reversal photographic materials, general positive photographic materials, direct positive type photographic materials, and photographic materials for specific uses (e.g. for printing, X-rays, high resolution, infrared, ultraviolet, etc.).

The present invention is illustrated in further detail below with reference to examples, but modes of practice of the invention are not limited to these examples.

EXAMPLE 1

A solution of a coupler 2-(2,4-di-tert-pentylphenoxy)-butanamide in dibutyl phthalate was protect-dispersed in an aqueous gelatin solution to form a coupler dispersion. This dispersion was mixed with a silver chlorobromide emulsion, and the resulting mixture was coated on a resin-coated paper support and then dried to prepare a sample. In this case, the coated amounts of the silver and coupler per 100 $cm^2$ were 0.80 mg. and 2.9 mg., respectively.

The thus prepared sample was exposed, and then developed at 30° C. for 1.5 minutes with a developer of the following composition:

| | |
|---|---|
| Sodium sulfite | 100 g. |
| Hydroquinone | 5.0 g. |
| Borax | 3.0 g. |
| Sodium bicarbonate | 3.0 g. |
| Boric acid | 3.5 g. |
| Potassium bromide | 1.0 g. |
| Phenidone | 0.2 g. |
| Water to make | 1 liter. |

Further, the aforesaid developed sample was processed at 30° C. for 1 minute with a deactivation bath of the composition shown below to deactivate the silver halide at the unexposed portion and, at the same time, to adsorb a paramine type compound thereon.

| | |
|---|---|
| 1-Phenyl-5-mercaptotetrazole | 0.01 g. |
| N-Ethyl-N-β-methanesulfonamidoethyl-3-methyl-4-aminoanilide | 5.0 g. |
| Anhydrous sodium sulfite | 2.0 g. |
| Sodium carbonate (monohydrate) | 50.0 g. |
| Potassium bromide | 1.0 g. |
| Water to make | 1 liter |

Subsequently, the sample was dipped at 30° C. for 4 minutes in an amplifying bath of the composition shown below, and then subjected to the same desilver-fixing and stabilization treatments as in the case of usual color photographic materials to form a cyan image.

| | |
|---|---|
| 38% Aqueous hydrogen peroxide solution | 20 ml. |
| Water to make | 1 liter. |

The $D_{min}$ and $D_{max}$ of the thus obtained cyan image were 0.02 and 2.33, respectively.

Further, the developed sample was processed with the same processing baths as above, except that the baths had been used for the processing of 40 sheets of cabinet size photographic materials. In this case, the $D_{min}$ and $D_{max}$ values were 0.07 and 2.30, respectively.

For comparison, the developed sample was processed in the same manner as above, except that only 1-phenyl-5-mercaptotetrazole was removed from the silver halide deactivation bath. In this case, the $D_{min}$ and $D_{max}$ values were 0.10 and 2.38 when the baths were fresh, but were 0.67 and 2.20 when the baths had been used for the processing of 40 sheets of cabinet size photographic materials, and thus marked increase of fog was observed.

EXAMPLE 2

Both sides of a polyester base were subjected to corona discharge treatment and then to subbing treatment. Thereafter, one side of the polyester base was coated with a mixture comprising a panchromatically sensitized silver indobromide emulsion and a dispersion prepared by protect-dispersing in an aqueous gelatin solution a solution formed by dissolving in dibutyl phthalate an equivalent amount of 1-(2,4,6-trichlorophenyl)-3-[3-(2,4-di-tert-pentylphenoxyacetamido)benzamido]-5-pyrazolone. In this case, the coated amounts of the silver and coupler per 100 $cm^2$ were 1.70 mg. and 7.0 mg., respectively. Subsequently, the other side of the polyester base was coated with a mixture comprising a panchromatically sensitized silver iodobromide emulsion and a dispersion prepared by protect-dispersing in an aqueous gelatin solution a solution in tricresyl phosphate of a 3.7:3 mixture of 2-(2,4-dioxo-3,3-di-n-propylazetidine-1-yl)-2-pivalyl-2'-chloro-5'-(4-(2,4-di-tert-pentylphenoxy)butanamido)acetanilide and 1-hydroxy-N-[4-(2,4-di-tert-pentylphenoxy)butyl]2-naphthamide. In this case, the coated amounts of the silver yellow coupler and cyan coupler per 100 $cm^2$ were 2.75 mg., 5.55 mg. and 4.5 mg., respectively.

The thus obtained color X-ray photographic material was exposed through a fluorescent intensifying screen and an aluminum wedge to X-rays from a tube energized at 60 $KV_p$ and 200 mA for 0.5 minute, and then color-developed at 24° C. for 7 minutes with a developer of the following composition:

| | |
|---|---|
| Benzyl alcohol | 15 ml. |
| Potassium sulfite | 5 g. |
| Potassium bromide | 0.5 g. |
| Hydroxylamine sulfate | 2 g. |
| 4-Amino-N-ethyl-N-(β-hydroxyethyl)-m-toluidine sulfate | 5 g. |
| Potassium carbonate | 30 g. |
| Ethylenediaminetetraacetic acid | 4.5 g. |
| Water to make (pH 10.1) | 1 liter |

Thereafter, the developed photographic material mentioned above was dipped at 24° C. for 30 minutes in a silver halide deactivation bath of the following composition:

| | |
|---|---|
| O-Phenanthroline | 20 mg. |
| Potassium carbonate | 10 g. |
| Water to make | 1 liter |

Subsequently, the photographic material was dipped in an amplifying bath of the same composition as in Example 1 at 24° C. for 5 minutes, and then sufficiently washed with water, and subsequently passed through usual bleaching, fixing and stabilization baths employed in the general color photography to obtain a X-ray image. The thus obtained X-ray image was a color image, and hence was large in amount of information. Moreover, the amount of silver used was about 1/30 the amount of silver used in the prior art.

EXAMPLE 3

A solution of a coupler 2-(1-benzyl-2,4-dioxoimidazolidine-3-yl)-2-pivalyl-2'-chloro-5'-[4-(2,4-di-tert-pentylphenoxy)butanamido]acetanilide in dibutyl phthalate was protect-dispersed in an aqueous gelatin solution to prepare a coupler dispersion. This dispersion was mixed with a silver chlorobromide emulsion, and the resulting mixture was coated on a resin-coated paper support to form a layer on the support. In this case, the coated amounts of the coupler and silver were 8.23 mg. and 0.87 mg., respectively, per 100 $cm^2$. On this layer was then formed a gelatin inter layer containing dioctyl hydroquinone. On this inter layer was further formed an ortho layer composed of a mixture comprising a green-sensitive silver chlorobromide emulsion and a coupler dispersion prepared by protect-dispersing in an aqueous gelatin solution a solution in dibutyl phthalate of a coupler 3-{2-chloro-5-[1-(octadecyl)succinimido]anilino}-1-(2,4,6-trichlorophenyl)-5-pyrazolone. The amounts of the coupler and silver used in said ortho layer were 4.3 mg. and 0.97 mg., respectively, per 100 $cm^2$. The said ortho layer was then coated with a gelatin solution of dioctyl hydroquinone to form a color turbidity-preventing layer. On this layer was further formed a panchromatic layer composed of a mixture comprising a red-sensitive silver chlorobromide emulsion and a coupler dispersion prepared by protect-dispersing in an aqueous gelatin solution a solution in dibutyl phthalate of a coupler 2-[2-(2,4-di-tert-pentylphenoxy)butanamido]-4,6-dichloro-5-methylphenol. The coated amounts of the coupler and silver used in said layer were 2.9 mg. and 0.73 mg., respectively, per 100 $cm^2$.

The thus formed sample was exposed through a wedge, and then processed in the same manner as in Example 1, except that 25 mg. of benzotriazole was used as the silver halide deactivator in place of 10 mg. of 1-phenyl-5-mercaptotetrazole, and, as the processing solutions, there were used those immediately after preparation and those incubated for 3 weeks after preparation, though only the amplifying bath was adjusted, after incubation, to a concentration of 0.75% by supplementation of hydrogen peroxide. The densities of the resulting color images were as shown in Table 1.

Table 1

| Incubation days of processing solutions | Densities of color images | | | | | |
|---|---|---|---|---|---|---|
| | Red | | Green | | Blue | |
| | $D_{min}$ | | $D_{min}$ | $D_{max}$ | $D_{min}$ | $D_{max}$ |
| 0 day | 0.08 | 2.24 | 0.09 | 2.20 | 0.15 | 1.95 |
| 21 days | 0.10 | 2.25 | 0.09 | 2.21 | 0.14 | 1.95 |

As is clear from Table 1, the sample, which had been subjected to the processing method of the present invention, gave excellent color images less in fog and sufficiently high in $D_{max}$, even when processed with processing solutions which had been incubated for 3 weeks.

EXAMPLE 4

A mixture comprising 1-hydroxy-N-[4-(2,4-di-tert-penthylphenoxy)butyl]-2-naphthamide (10.1 mg/100 $cm^2$), 4-(2-ethoxycarbonylphenylazo)-1-hydroxy-N-[4-(2,4-di-tert-pentylphenoxy)butyl]-2-naphthamide (3.2 mg/100 $cm^2$) and 1-oxo-2-(1-phenyl-5-tetrazolylthio)-6-[α-(2,4-di-tert-pentylphenoxy)butanamido]-indane (4.4 mg/100 $cm^2$) was dissolved in mixed solvents of ethyl acetate and tricresyl phosphate, and then charged with an aqueous gelatin solution and a dispersion aid Alkanol XC, and then protect-dispersed by means of a homogenizer to form a coupler dispersion. This dispersion was mixed with a high speed red-sensitive silver iodobromide emulsion (Ag 2.5 mg/100 $cm^2$), and the resulting mixture was coated on the cellulose triacetate film base as above to form an emulsion layer on the film base.

The coated amounts of each coupler and silver were as shown in the parentheses.

On the thus formed layer was formed an inter layer composed of a gelatin solution of 2,5-di-octyl hydroquinone. On this inter layer was then coated an ortho layer composed of a mixture comprising a high speed green-sensitive silver iodobromide emulsion (Ag 1.8 mg/100 $cm^2$) and a coupler dispersion prepared by protect-dispersing in an aqueous gelatin solution a solution in dibutyl phthalate of 1-(2,4,6-trichlorophenyl)-3-[3-(2,4-di-tert-pentylphenoxyacetamido)benzamido]-5-pyrazolone (10.2 mg/100 $cm^2$), 1-(2,4,6-trichlorophenyl)3-[3-(2,4-di-tert-pentylphenoxyacetamido)benzamido]-4-(4-methoxyphenylazo)-5-pyrazolone (2.2 mg/100 cm²) and 1-oxo-2-(1-phenyl-5-tetrazolyl-thio)-6-[α-(2,4-di-tert-pentylphenoxy)butanamido]-indane (0.7 mg/100 cm²). On the said ortho layer was formed a yellow filter layer of colloidal silver containing 2,5-di-tert-octyl hydroquinone. On this filter layer was further formed as the upper-most layer a regular layer composed of a mixture comprising a high speed blue-sensitive silver iodobromide emulsion (2.0 mg/100 cm²) and a coupler dispersion prepared by protect-dispersing in an aqueous gelatin solution a solution in dibutyl phthalate of 2-(1-benzyl-2,4-dioxoimidazolidine-3-yl)-2-pivaloyl-2'-chloro-5'-[2-(3-pentadecylphenoxy)butanamido]acetanilide (25 mg/100 cm²). Subsequently, a gelatin protective layer was formed on said upper-most layer.

On the other hand, the photographic material B was exposed through a wedge, and then processed with the below-mentioned processing solutions. The processing temperature was 30° C., and the order and periods of processing steps were as follows:

Development deactivation (3') - amplification (1') - fixing (1'30") - water-washing (1') - stabilization (10").

Development deactivation solution:

| | |
|---|---|
| Sodium sulfite | 10 g. |
| Potassium carbonate | 20 g. |
| Sodium hydroxide | 5 g. |
| Hydroquinone | 5 g. |
| Phenidone | 0.3 g. |
| 1-Phenyl-5-mercaptotetrazole | 3 mg. |
| N-Ethyl-N-β-methanesulfonamidoethyl-3-methyl-4-aminoaniline sulfate | 8 g. |

Amplifying solution:

| | |
|---|---|
| 35% Aqueous hydrogen peroxide solution | 25 ml. |
| Water to make | 1 liter |
| Sodium hydroxide to make | pH 8.5 |

Fixing solution:

| | |
|---|---|
| Ammonium thiosulfate (70% aqueous solution) | 180 ml. |
| Sodium sulfite | 7.0 g. |
| Water to make (pH 6.0) | 1 liter |
| Stabilization solution: | |
| Glacial acetic acid | 20 ml. |
| Water | 800 ml. |
| Sodium acetate to make | pH 3.5–4.0 |
| Water to make | 1 liter |

The densities of the color images obtained both in the cases where the photographic material was passed and was not passed through the amplifying bath were as shown in Table 2.

Table 2

| Amplifying bath | Densities of color images | | | | | |
|---|---|---|---|---|---|---|
| | Red | | Green | | Blue | |
| | $D_{min}$ | $D_{max}$ | $D_{min}$ | $D_{max}$ | $D_{min}$ | $D_{max}$ |
| Used | 0.08 | 0.47 | 0.08 | 0.51 | 0.07 | 0.45 |
| Not used | 0.08 | 2.04 | 0.08 | 2.21 | 0.07 | 1.75 |

From Table 2, it is understood that a photographic material processed according to the method of the present invention can give an excellent image even when the photographic material has been reduced in amount of silver.

EXAMPLE 5

A sample prepared in the same manner as in Example 1 was exposed and developed in the same manner as in Example 1. The developed sample was processed at 30° C. for 1.5 minutes with a solution having the composition shown below.

| | |
|---|---|
| Ammonium thiosulfate (70% aqueous solution) | 180 ml. |
| Sodium sulfite | 7.0 g. |
| Water to make (pH 6.0) | 1 liter |

The sample was further processed at 30° C. for 1 minute with a deactivation bath of the composition shown below, thereby to adsorb a paramine type compound thereon.

| | |
|---|---|
| N-Ethyl-N-β-methanesulfonamidoethyl-3-methyl-4-aminoaniline sulfate | 5.0 g |
| Anhydrous sodium sulfite | 2.0 g. |
| Sodium carbonate (monohydrate) | 50.0 g. |
| Potassium bromide | 1.0 g. |
| Water to make | 1 liter |

Susequently, the sample was dipped at 30° C. for 4 minutes in an amplifying bath of the composition shown below, and then subjected to the same desilver-fixing and stabilization treatments as in the case of usual color photographic materials to form a cyan image.

| | |
|---|---|
| 38% Aqueous hydrogen peroxide solution | 20 ml. |
| Water to make | 1 liter |

Minimum density ($D_{min}$) and maximum density ($D_{max}$) of the resulted cyan image were 0.02 and 2.35, respectively.

For comparison, the above mentioned sample was processed through the same procedures as above, except that the processing with the bath containing a silver halide solvent was omitted. $D_{min}$ and $D_{max}$ of the thus processed comparative sample were 0.13 and 2.33, respectively.

It will be apparent that the photosensitive material processed according to this invention is effectively reduced in fog.

EXAMPLE 6

A photographic material prepared in the same manner as in Example 2 was exposed to X-rays in the same manner as in Example 2.

Subsequently, the photographic material was dipped in an amplifying bath of the same composition as in Example 1 at 24° C. for 5 minutes, sufficiently washed with water, and then passed through a usual stabilization bath employed in the general color photography to obtain a color X-ray image. The thus obtained X-ray image was a color image, and hence imparted a large amount of information. Moreover, the amount of silver used was about 1/30 the amount of silver used in the prior art.

EXAMPLE 7

The sample formed in the same manner as in Example 3 was exposed through a wedge, and then processed in the same manner as in Example 5, except that as the processing solutions, there were used those immediately after preparation (fresh solutions) and those after processing of 40 sheets of cabinet size photographic materials (fatigued solutions). For comparison, a control sample prepared in the aforesaid manner was processed in the same manner as above, except that the silver halide solvent-containing bath according to the present invention was not used. The densities of the resulting color images were as shown in Table 3.

Table 3

| Processing | Fatigue degree of processing solutions | Densities of color images | | | | | |
|---|---|---|---|---|---|---|---|
| | | Red | | Green | | Blue | |
| | | $D_{min}$ | $D_{max}$ | $D_{min}$ | $D_{max}$ | $D_{min}$ | $D_{max}$ |
| Present invention | Immediately after preparation | 0.06 | 2.27 | 0.07 | 2.24 | 0.11 | 2.01 |
| | After processing of 40 cabinets | 0.09 | 2.26 | 0.11 | 2.22 | 0.13 | 2.02 |
| Control | Immediately after preparation | 0.13 | 2.30 | 0.15 | 2.29 | 0.18 | 2.08 |
| | After processing of 40 cabinets | 0.64 | 2.22 | 0.68 | 2.18 | 0.83 | 2.02 |

As is clear from Table 3, the sample, which had been subjected to the processing method of the present invention, gave excellent color images less in fog and sufficiently high in $D_{max}$, even when processed with fatigued solutions.

What we claim is:

1. In a method for processing an imagewise exposed light-sensitive silver halide photographic material containing a coupler, which method comprises developing said silver halide photographic material with a developing bath for imagewise forming a catalytic silver and thereafter amplifying with an amplifying bath containing hydrogen peroxide, the improvement comprising treating, during said developing or after developing but before said amplifying, said exposed light-sensitive silver halide photographic material with a primary amine color developing agent and a compound capable of adsorbing on or dissolving silver halide at the exposed portion of the photographic material, thereby to effect deactivation of said unexposed silver halide, said compound being selected from the group consisting of mercapto compounds, azole compounds, oxonium compounds, silver halide solvents, benzyladenine, 8-hydroxyquinoline, o-phenanthroline, thiosugar and dyes.

2. A method according to claim 1, wherein said developing bath is that which contains a black-white developing agent, while a color developing agent is included in any processing bath just preceeding to the amplifying bath.

3. A method according to claim 1, wherein said developing bath contains a color developing agent.

4. A method according to claim 1, wherein said developing bath contains both a black-white developing agent and a color developing agent.

5. A method according to claim 1, wherein said compound capable of adsorbing on said unexposed silver halide is one member selected from the group consisting of 2-mercaptobenzimidazole, 2-mercaptobenzothiazole, 2-mercapto-5-nitrobenzothiazole, 4-methyl-2-mercaptothiazole, 4,5-dimethyl-2-mercaptothiazole, 1-phenyl-5-mercaptotetrazole, 1,2-dimethyl-5-mercapto-1,3,4-triazole, 2-mercapto-5-phenyl-1,3,4-oxadiazole, β-mercaptoacetic acid, β-mercaptopropionic acid, thiosalicyclic acid, benzotriazole, 5-nitrobenzimidazole, 5-methylbenzotriazole, 4-chlorobenzotriazole, 5,5-diphenylhydantoin, 2-methyl-3-(γ-sulfoxypropyl)-benzoselenazole and 3-methylbenzothiazole toluene sulfonate.

6. A method according to claim 1, wherein said compound capable of adsorbing on said silver halide is one member selected from the group consisting of N-isopropyl-α-picolinium bromide and N-ethyl-2-methylbenzothiazolium chloride.

7. A method according to claim 1, wherein said compound capable of adsorbing on said unexposed silver halide is one member selected from the group consisting of phenosafranine, pinkryptol yellow, 1, 1', 3, 3, 3', 3'-hexamethyl-5,5'-dinitroimidocarboxyanine-p-toluenesolfonate, and 1,3-diaryl-2-[(3,5-dimethyl-1-phenyl-4-pyrazolyl)vinyl]-imidazo-(4,5-b)-quinoxalium iodide.

8. A method according to claim 1, wherein said compound capable of adsorbing on said unexposed silver halide is one member selected from the group consisting of benzyladenine, 8-hydroxyquinoline, o-phenanthroline and thiosugar.

9. A method according to claim 1 wherein said silver halide solvent is selected from the group consisting of alkali metal and ammonium thiosulfates, cyanides and thiocyanamines.

* * * * *